US006224515B1

(12) United States Patent
Chen

(10) Patent No.: US 6,224,515 B1
(45) Date of Patent: May 1, 2001

(54) STEPPING EXERCISER

(76) Inventor: Tsung-Yu Chen, No. 23-4, Ting-Liao, San-Ho Tsun, Shiu-Shang Hsiang, Chiayi Hsien (TW)

( * ) Notice: Subject to any disclaimer, the term of this patent is extended or adjusted under 35 U.S.C. 154(b) by 0 days.

(21) Appl. No.: 09/431,203

(22) Filed: Nov. 1, 1999

(30) Foreign Application Priority Data

Mar. 23, 1999 (TW) ..... 88204415

(51) Int. Cl.[7] ..... A63B 22/04
(52) U.S. Cl. ..... 482/53; 482/909
(58) Field of Search ..... 482/51, 52, 53, 482/70, 79, 80, 146, 147, 148, 909

(56) References Cited

U.S. PATENT DOCUMENTS

| | | | | |
|---|---|---|---|---|
| 4,976,425 | * | 12/1990 | Barnes et al. | 482/147 |
| 5,545,111 | * | 8/1996 | Wang et al. | 482/53 |
| 5,628,709 | * | 5/1997 | Chen | 482/146 |
| 5,888,175 | * | 3/1999 | Chang | 482/53 |
| 5,947,873 | * | 9/1999 | Sands et al. | 482/52 |

* cited by examiner

*Primary Examiner*—Stephen R. Crow
(74) *Attorney, Agent, or Firm*—Rosenberg, Klein & Lee

(57) ABSTRACT

A stepping exerciser includes a base having an upright tubular member disposed thereon. The tubular member has lower left and right portions formed with a respective circumferentially extending slot, and upper left and right portions having a respective pivot arm extending radially therefrom. A rotary member is disposed inside the tubular member and is rotatable relative to the tubular member about an axis of the tubular member. The rotary member has a pair of force transmitting rods that extend outwardly and respectively of the tubular member through the slots. Each of a pair of pivot couplers is sleeved rotatably on a respective pivot arm, and has a movement driving rod that extends downwardly therefrom and that abuts against a respective force transmitting rod. Each of left and right pedal arms has a front end connected to a respective one of the pivot couplers. Each of a pair of resistance cylinders interconnects the base and the rear end of a respective pedal arm. A counting device includes a display unit mounted on the base for generating a count output corresponding to the amount of exercise performed when the stepping exerciser is in use.

13 Claims, 8 Drawing Sheets

STEPPING EXERCISER

BACKGROUND OF THE INVENTION

1. Field of the Invention

The invention relates to a stepping exerciser, more particularly to one that does not pose safety problems to children, that has a relatively simple construction to reduce the production time, and that incorporates a counting device for generating a count output corresponding to the amount of exercise performed when the stepping exerciser is in use.

2. Description of the Related Art

Referring to FIG. 1, a conventional stepping exerciser 1 is shown to comprise a base 11, a pair of pedal arms 12 mounted pivotally on the base 11, a pair of resistance cylinders 13 which interconnect the base 11 and the pedal arms 12 to provide resistance to pivoting movement of the pedal arms 12 relative to the base 11, and a pull cord assembly 2. The pull cord assembly 2 includes a U-shaped bracket 21 mounted on a bottom side of the base 11, a pulley 22 mounted rotatably on the bracket 21 about a vertical axis, and a pull cord 23 trained on the pulley 22 and having opposite ends connected to the pedal arms 12, respectively. Thus, when one of the pedal arms 12 is pivoted downwardly relative to the base 11, the other one of the pedal arms 12 will be pulled to pivot upwardly by virtue of the pulling action of the pull cord 23.

Some of the drawbacks of the aforesaid conventional stepping exerciser 1 are as follows:

1. The pull cord assembly 2 is exposed and can pose safety problems when a child plays with the same.
2. The pull cord assembly 2 involves numerous components that complicate the construction and that increase the production time of the stepping exerciser 1.
3. The stepping exerciser 1 does not incorporate any means for generating a count output corresponding to the amount of exercise performed by the user.

SUMMARY OF THE INVENTION

Therefore, the object of the present invention is to provide a stepping exerciser that does not pose safety problems to children, that has a relatively simple construction to reduce the production time, and that incorporates a counting device for generating a count output corresponding to the amount of exercise performed when the stepping exerciser is in use.

According to the present invention, a stepping exerciser comprises:

a base having an upright tubular member disposed thereon, the tubular member having lower and upper left and right portions, each of the lower left and right portions being formed with a circumferentially extending slot, each of the upper left and right portions having a pivot arm extending radially therefrom;

a rotary member disposed inside the tubular member and rotatable relative to the tubular member about an axis of the tubular member, the rotary member having a pair of force transmitting rods that extend outwardly of the tubular member through the slots in the lower left and right portions of the tubular member, respectively;

a pair of pivot couplers, each of which is sleeved rotatably on the pivot arm of a respective one of the upper left and right portions of the tubular member, and each of which has a movement driving rod that extends downwardly therefrom and that abuts against a respective one of the force transmitting rods;

left and right pedal arms, each of which has a rear end, and a front end connected to a respective one of the pivot couplers such that downward pivoting movement of one of the pedal arms relative to the tubular member causes the movement driving rod on the respective one of the pivot couplers to push the respective one of the force transmitting rods for rotating the rotary member axially inside the tubular member, and causes the other one of the force transmitting rods to push the movement driving rod on the other one of the pivot couplers for upward pivoting movement of the other one of the pedal arms relative to the tubular member;

a pair of resistance cylinders, each of which interconnects the base and the rear end of a respective one of the pedal arms to provide resistance to pivoting movement of the respective one of the pedal arms relative to the tubular member; and a counting device including a display unit mounted on the base for generating a count output corresponding to amount of exerciser performed when the stepping exerciser is in use.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
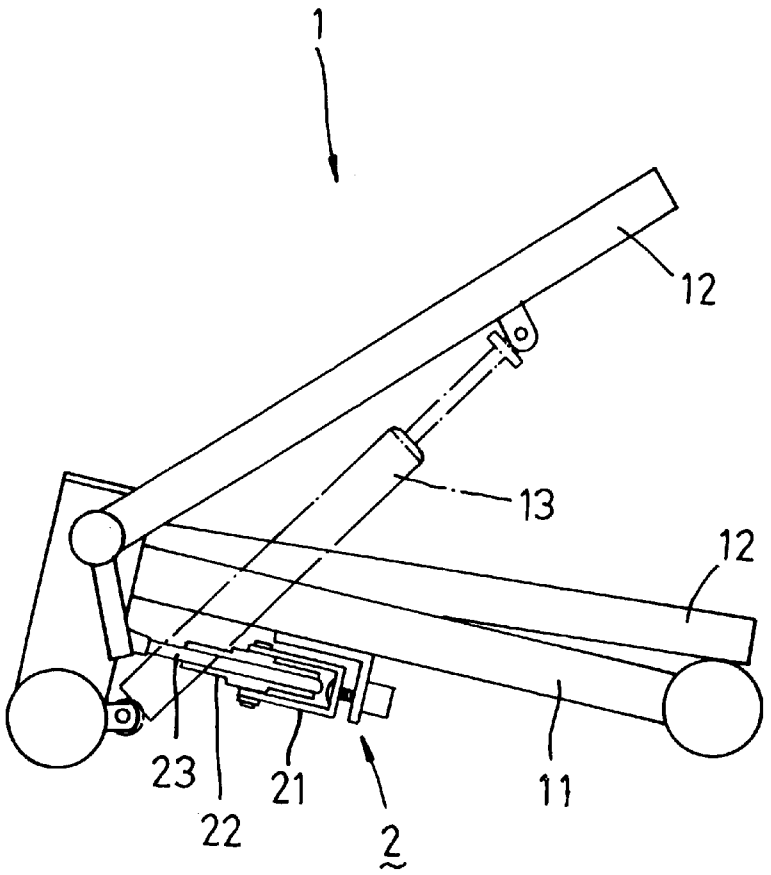
FIG. 1 PRIOR ART
FIG. 1 is a schematic side view illustrating a conventional stepping exerciser.

Before the present invention is described in greater detail, it should be noted that like elements are denoted by the same reference numerals throughout the disclosure.

Figure 2:
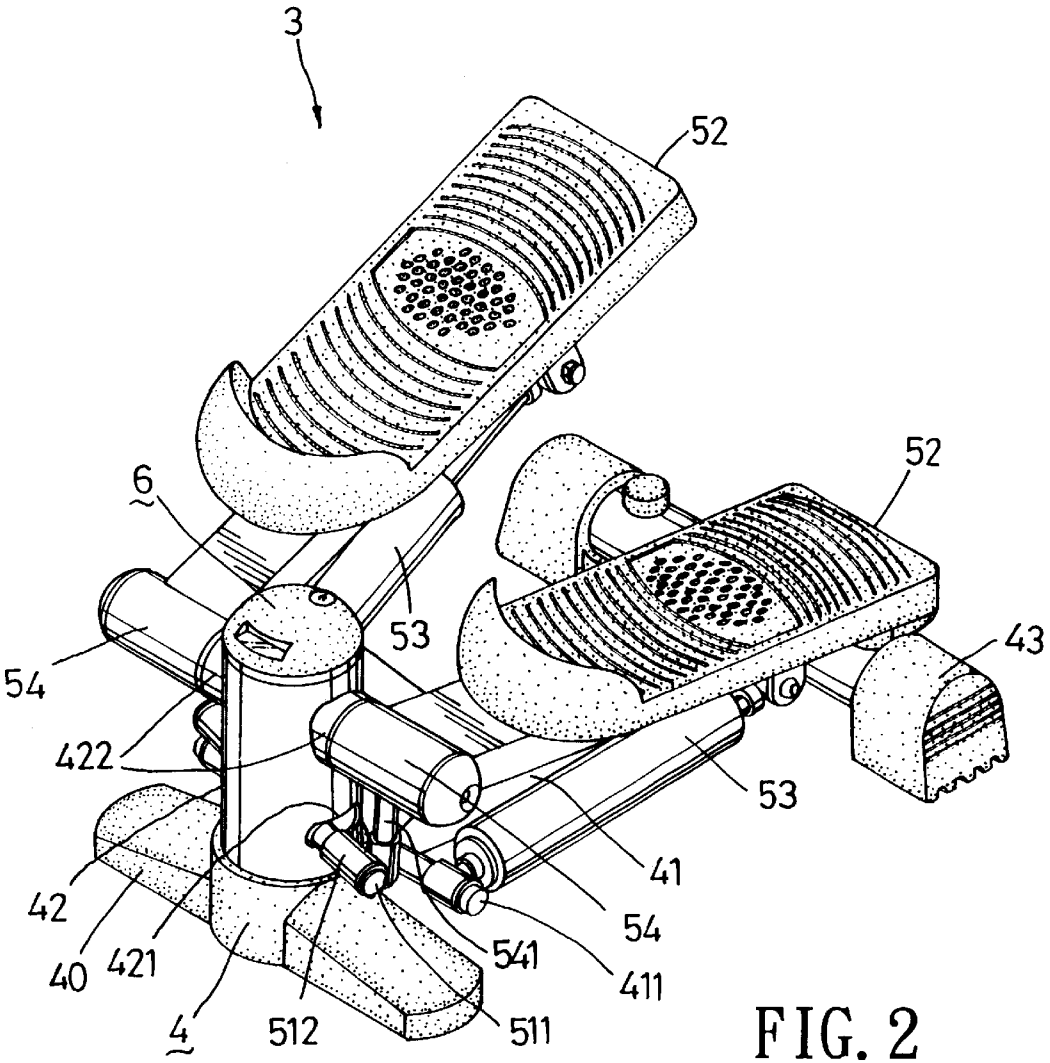
FIG. 2 is a perspective view illustrating the first preferred embodiment of a stepping exerciser according to the present invention.
Figure 3:
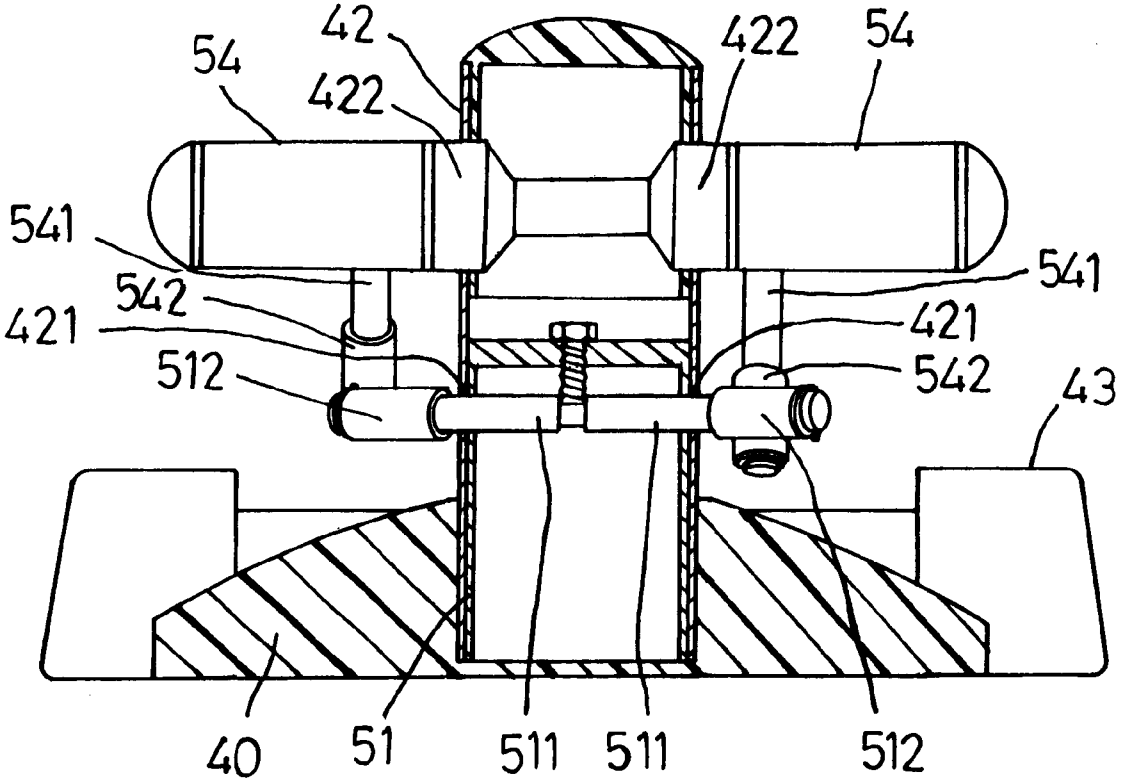
FIGS. 3 and 4 are sectional views of the first preferred embodiment.
Figure 4:
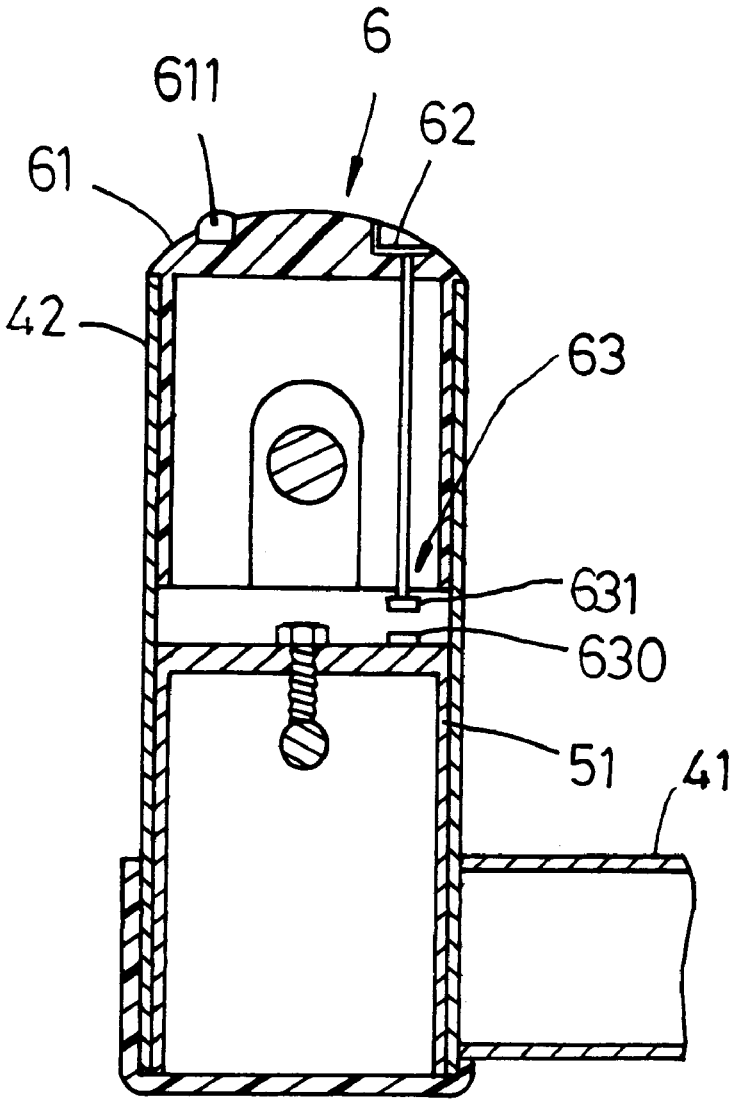

Referring to FIGS. 2, 3 and 4, the first preferred embodiment of a stepping exerciser 3 according to the present invention is shown to comprise a base 4, a rotary member 51, a pair of pivot couplers 54, left and right pedal arms 52, a pair of resistance cylinders 53, and a counting device 6.

The base 4 includes an elongate main frame member 41, a front frame member 40 connected transversely to a front end of the main frame member 41, an upright tubular member 42 mounted on the front frame member 40, and a rear frame member 43 connected transversely to a rear end of the main frame member 41. A pair of connecting rods 411 project from opposite lateral sides of the main frame member 41 and are disposed adjacent to the front frame member 40. The tubular member 42 has lower left and right portions, each of which is formed with a circumferentially extending slot 421. The tubular member 42 further has upper left and right portions, each of which has a pivot arm 422 extending radially therefrom. In this embodiment, the pivot arms 422 are connected to one another at an interior of the tubular member 42.

The rotary member 51 is disposed inside the tubular member 42 and is rotatable relative to the tubular member 42 about an axis of the latter. The rotary member 51 has a pair of force transmitting rods 511 that extend outwardly of the tubular member 42 through the slots 421 in the lower left and right portions of the tubular member 42, respectively. In this embodiment, the force transmitting rods 511 are connected to one another interiorly of the rotary member 51. Each of the force transmitting rods 511 has a rotary sleeve 512 which is sleeved rotatably thereon.

Each of the pivot couplers 54 is sleeved rotatably on the pivot arm 422 of a respective one of the upper left and right portions of the tubular member 42. Each of the pivot couplers 54 has a movement driving rod 541 that extends downwardly therefrom and that has a rotary sleeve 542 which is sleeved rotatably thereon. The rotary sleeve 542 on the movement driving rod 541 of each of the pivot couplers 54 abuts against the rotary sleeve 512 on a respective one of the force transmitting rods 511. The rotary sleeves 512, 542 ensure smooth transmission of forces when the stepping exerciser 3 is in use.

Each of the pedal arms 52 has a front end connected to a respective one of the pivot couplers 54, and a rear end that extends toward the rear frame member 43. Each of the resistance cylinders 53 has one end connected pivotally to one of the connecting rods 411 on the main frame member 41, and the other end connected pivotally to the rear end of a respective one of the pedal arms 52. The resistance cylinders 53 provide resistance to pivoting movement of the pedal arms 52 relative to the tubular member 42.

Referring to FIG. 4, the counting device 6 includes a sensing unit 63 for detecting axial rotation of the rotary member 51 inside the tubular member 42, and a display unit 62 mounted on the base 4 and connected electrically to the sensing unit 63. In the preferred embodiment, the display unit 62 is mounted on the tubular member 42. More specifically, the tubular member 42 has a top end with a cap 61 mounted thereon, and the display unit 62 is mounted on the cap 61. The sensing unit 63 includes a magnet 630 mounted on a top end of the rotary member 51, and a magnetic sensor 631 extending downwardly from the cap 61 into the tubular member 42 and toward the magnet 630 and connected electrically to the display unit 62. A mode select key 611 is mounted on the cap 61 and is connected electrically to the display unit 62. The mode select key 611 is operable to initiate operation of the display unit 62 in one of a timing mode, where the display unit 62 shows a count value corresponding to the time duration of use of the stepping exerciser 3, and a counting mode, where the display unit 62 shows another count value corresponding to the number of axial rotations of the rotary member 51 detected by the sensing unit 63.

Figure 5:
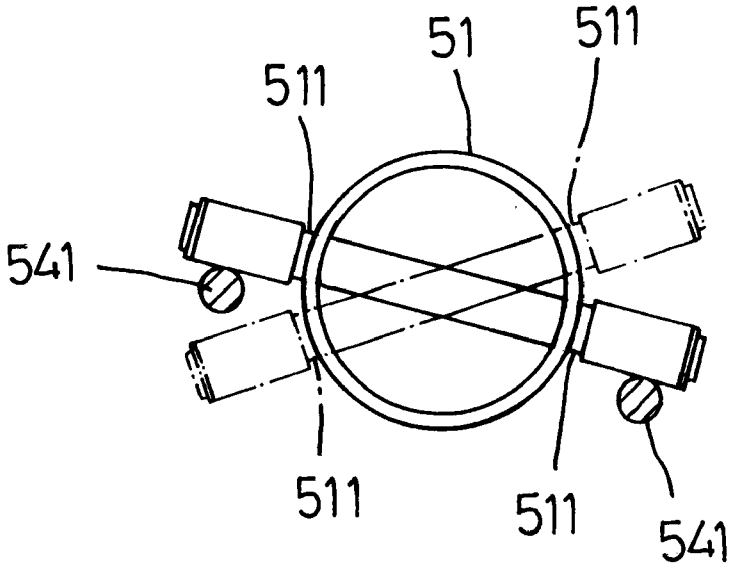
FIG. 5 is a schematic top view illustrating the action of a rotary member when the first preferred embodiment is in use.

Referring to FIGS. 2 and 5, when one of the pedal arms 52 is pivoted downwardly relative to the tubular member 42 against the action of the respective resistance cylinder 53, the movement driving rod 541 on the respective one of the pivot couplers 54 pushes the respective one of the force transmitting rods 511 so as to rotate the rotary member 51 axially inside the tubular member 42. Thereafter, the other one of the force transmitting rods 511 pushes the movement driving rod 541 on the other one of the pivot couplers 54 for upward pivoting movement of the other one of the pedal arms 52 relative to the tubular member 42. Thus, alternating upward and downward pivoting movement of the pedal arms 52 occurs when the stepping exerciser 3 is in use.

Unlike the aforesaid conventional stepping exerciser 1, which employs a pull cord assembly 2 that involves numerous components, the stepping exerciser 3 of this invention uses force transmitting rods 511 on a rotary member 51 and movement driving rods 541 on a pair of pivot couplers 54 to ensure alternating upward and downward pivoting movement of the pedal arms 52. The stepping exerciser 3 of this invention thus has a relatively simple construction that facilitates production of the same, and the exposed components of the stepping exerciser 3 of this invention do not pose safety problems to children. In addition, the inclusion of the counting device 6 enables the generation of a count output for indicating the amount of exercise performed when the stepping exerciser 3 of this invention is in use.

Figure 6:
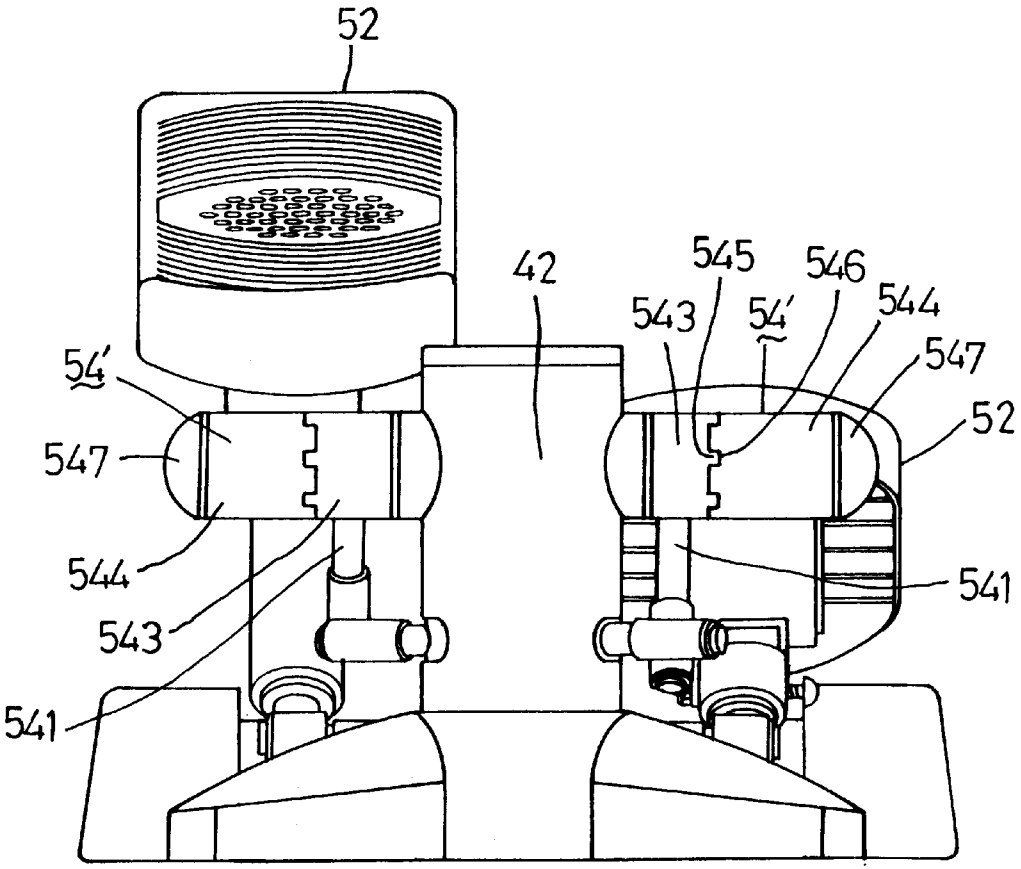
FIG. 6 is a schematic view illustrating the second preferred embodiment of a stepping exerciser according to the present invention.

FIG. 6 illustrates the second preferred embodiment of a stepping exerciser according to this invention. Unlike the previous embodiment, each of the pivot couplers 54' includes an inner coupling portion 543 and an outer coupling portion 544. The inner coupling portion 543 is disposed between the tubular member 42 and the outer coupling portion 544, and is provided with the movement driving rod 541. The outer coupling portion 544 is connected to the front end of the respective one of the pedal arms 52. The inner and outer coupling portions 543, 544 are provided with complementary teeth 545, 546 at confronting ends thereof for interengaging releasably the inner and outer coupling portions 543, 544. The inner and outer coupling portions 543, 544 are co-rotatable when engaged, and are rotatable relative to one another when disengaged such that an angle formed between the movement driving rod 541 on the inner coupling portion 543 and the pedal arm 52 on the outer coupling portion 544 can be adjusted to vary the range of pivoting movement of the pedal arms 52 relative to the tubular member 42. Locking members 547 are provided on the pivot arms (not visible) for retaining the inner and outer coupling portions 543, 544 in the engaged state, and are released from the pivot arms when it is desired to adjust the range of pivoting movement of the pedal arms 52.

Figure 7:
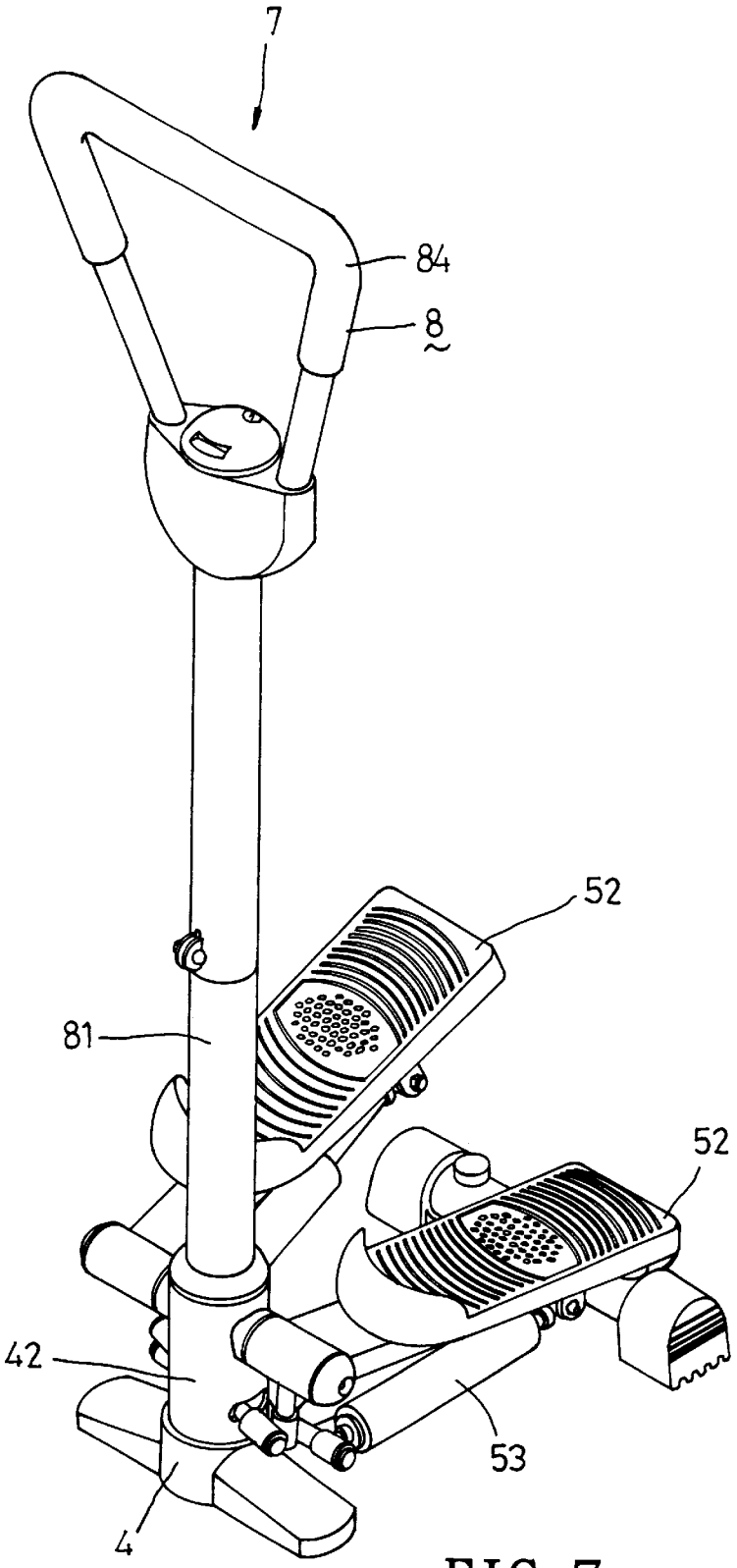
FIG. 7 is a perspective view illustrating the third preferred embodiment of a stepping exerciser according to the present invention.
Figure 8:
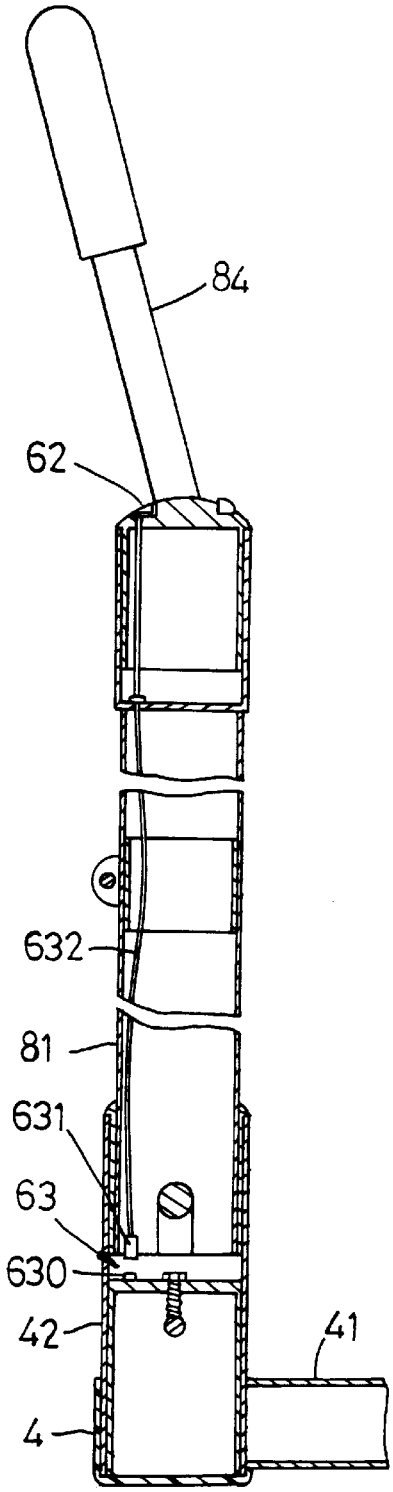
FIG. 8 is a sectional view of the third preferred embodiment.

FIGS. 7 and 8 illustrate the third preferred embodiment of a stepping exerciser 7 according to the present invention. Unlike the previous embodiments, the stepping exerciser 7 further comprises a handle unit 8 having an upright post 81. The post 81 has a bottom end mounted on the tubular member 42, and a top end provided with a grip member 84 for gripping purposes. The display unit 62 is mounted on the top end of the post 81, and the magnetic sensor 631 is mounted on the bottom end of the post 81 and is connected electrically to the display unit 62 via an electrical cable 632 that is disposed inside the post 81. Since the operation and the configuration of the remaining components of the stepping exerciser 7 are similar to those of the previous embodiments, a detailed description of the same will be dispensed with herein for the sake of brevity.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A stepping exerciser comprising:

a base having an upright tubular member disposed thereon, said tubular member having lower and upper left and right portions, each of said lower left and right portions being formed with a circumferentially extending slot, each of said upper left and right portions having a pivot arm extending radially therefrom;

a rotary member disposed inside said tubular member and rotatable relative to said tubular member about an axis of said tubular member, said rotary member having a pair of force transmitting rods that extend outwardly of said tubular member through said slots in said lower left and right portions of said tubular member, respectively;

a pair of pivot couplers, each of which is sleeved rotatably on said pivot arm of a respective one of said upper left and right portions of said tubular member, and each of which has a movement driving rod that extends downwardly therefrom and that abuts against a respective one of said force transmitting rods;

left and right pedal arms, each of which has a rear end, and a front end connected to a respective one of said pivot couplers such that downward pivoting movement of one of said pedal arms relative to said tubular member causes said movement driving rod on the respective one of said pivot couplers to push the respective one of said force transmitting rods for rotating said rotary member axially inside said tubular member, and causes the other one of said force transmitting rods to push said movement driving rod on the other one of said pivot couplers for upward pivoting movement of the other one of said pedal arms relative to said tubular member;

a pair of resistance cylinders, each of which interconnects said base and said rear end of a respective one of said pedal arms to provide resistance to pivoting movement of the respective one of said pedal arms relative to said tubular member; and a counting device including a display unit mounted on said base for generating a count output corresponding to amount of exercise performed when said stepping exerciser is in use.

2. The stepping exerciser as claimed in claim 1, wherein said counting device further includes a sensing unit connected to said display unit and capable of detecting axial rotation of said rotary member inside said tubular member.

3. The stepping exerciser as claimed in claim 2, wherein said display unit is operable in a counting mode, where said display unit shows a count value corresponding to number of the axial rotations of said rotary member detected by said sensing unit.

4. The stepping exerciser as claimed in claim 3, wherein said display unit is further operable in a timing mode, where said display unit shows another count value corresponding to time duration of use of said stepping exerciser.

5. The stepping exerciser as claimed in claim 1, wherein said display unit is operable in a timing mode, where said display unit shows a count value corresponding to time duration of use of said stepping exerciser.

6. The stepping exerciser as claimed in claim 1, wherein said display unit is mounted on said tubular member.

7. The stepping exerciser as claimed in claim 6, wherein said tubular member has a top end with a cap mounted thereon, said display unit being mounted on said cap.

8. The stepping exerciser as claimed in claim 2, wherein said sensing unit includes a magnet mounted on said rotary member, and a magnetic sensor mounted on said tubular member and connected to said display unit.

9. The stepping exerciser as claimed in claim 1, wherein each of said force transmitting rods and said movement driving rods has a rotary sleeve which is sleeved rotatably thereon.

10. The stepping exerciser as claimed in claim 1, wherein each of said pivot couplers includes an inner coupling portion and an outer coupling portion, said inner coupling portion being disposed between said tubular member and said outer coupling portion and being provided with said movement driving rod, said outer coupling portion being connected to said front end of the respective one of said pedal arms, each of said pivot couplers further comprising angle adjusting means for releasably interengaging said inner and outer coupling portions such that an angle between said movement driving rod on said inner coupling portion and said pedal arm on said outer coupling portion is adjustable.

11. The stepping exerciser as claimed in claim 10, wherein said inner and outer coupling portions are formed with complementary teeth that serve as said angle adjusting means.

12. The stepping exerciser as claimed in claim 1, further comprising a handle unit having an upright post, said post having a bottom end mounted on said tubular member, and a top end provided with a grip member.

13. The stepping exerciser as claimed in claim 12, wherein said display unit is mounted on said top end of said post.

* * * * *